US005798613A

United States Patent [19]

Lee

[11] Patent Number: 5,798,613

[45] Date of Patent: Aug. 25, 1998

[54] MAGNETRON WITH TEN ANODE VANES OPERATING AT 1250-1500 W

[75] Inventor: Jong Soo Lee, Kyungki-Do, Rep. of Korea

[73] Assignee: LG Electronics, Inc., Rep. of Korea

[21] Appl. No.: 734,381

[22] Filed: Oct. 17, 1996

[30] Foreign Application Priority Data

Oct. 20, 1995 [KR] Rep. of Korea ..... 36338/1995

[51] Int. Cl.[6] ..... H01J 25/587

[52] U.S. Cl. ..... 315/39.51; 315/39.75

[58] Field of Search ..... 315/39.51, 39.75

[56] References Cited

U.S. PATENT DOCUMENTS 5,049,782 9/1991 Aiga et al. ..... 315/39.75 X 5,635,798 6/1997 Ogura et al. ..... 315/39.51 X

OTHER PUBLICATIONS

Hull et al., "High Power Interdigital Magnetrons", IRE Proceedings, vol. 36, No. 11, pp. 1357–1363, Nov. 1948.

*Primary Examiner*—Robert J. Pascal

*Assistant Examiner*—Justin P. Bettendorf

*Attorney, Agent, or Firm*—Ostrolenk, Faber, Gerb & Soffen, LLP

[57] ABSTRACT

A magnetron which is capable of optimizing a resonance structure by changing the number of vanes, the height of vanes, an outer diameter of a cathode and a diameter of a working space, the improvements are characterized in that the resonance unit has ten vanes having each height of 10.5 mm~12.5 mm, an outer diameter of the cathode is 4.0 mm~4.6 mm, a diameter of the working space between each symmetrical vane is 9.0 mm~12.0 mm to obtain a high frequency output of 1250 W~1500 W from an operating voltage of 4.3 kV~4.7 kV.

1 Claim, 3 Drawing Sheets

MAGNETRON WITH TEN ANODE VANES OPERATING AT 1250-1500 W

BACKGROUND OF THE INVENTION

1. Field of the Invention

The present invention relates to a magnetron, and more particularly, to a magnetron which is capable of optimizing a resonance structure by changing the number of vanes, the height of vanes, an outer diameter of a cathode and a diameter of a working space.

2. Description of the Prior Art

Referring to FIGS. 1 through 3, a conventional magnetron includes an input unit 10 having a choke coil 12 and a condenser 14 at its lower portion, an operation unit 20 disposed on the input unit 10 and having a cathode 30, a resonance unit 40, a magnetic unit 50 and a cooling unit 60, and an output unit 70 defined on the operation unit 20.

The cathode 30 is mounted at the central portion of the operation unit 20, and upper and lower shields 31,32 in the shape of a circular plate is mounted for preventing a deviation of electrons at the upper and lower portions of the cathode, and between the upper and lower shields 31,32 is disposed a spiral-shaped filament 33 for releasing an electron.

The resonance unit 40 is disposed separately by a predetermined interval from an outer peripheral portion of the cathode 30. There are provided twelve vanes 41, one end of which is radially disposed on an inner wall of a cylindrical anode 42 and at the other end of which two strap rings 43 in the shape of a ring are alternatively connected to the upper and lower portions of the vane 41, respectively, with a predetermined interval therebetween to form an alternate electrode.

At the upper and lower portions of the resonance unit 40 are formed the magnetic unit 50 having a plurality of magnets 51 to maintain a constant magnetic field.

On the upper portion of the operation unit 20 are provided a cap antenna 71 in the shape of a cap to project a microwave generated by the operation unit 20, and at an outer wall of the operation unit 20 are disposed the cooling unit 60 having a plurality of cooling pins 61 for cooling heat generated by the operation unit 20.

The operation and disadvantages of the conventional magnetron will now be described in detail.

First, when a constant electric field is applied between the cathode 30 and the vane 41 through the input unit 10 and a constant magnetic field is applied in the direction of the shaft of the cathode 30, a high frequency electric field is generated to be concentrated on the other end portion of each vane 41.

Here, the electrical potential value of the high-frequency of each neighboring vane 41 alternatively connected by the strap ring 43 is reversed.

Next, an electron released from the filament 33 of the cathode 30 moves freely in a working space A except the cathode 30 in the space obtained by connecting the other end of each vane 41. Here, the upper and lower shields 31,32 prevents electrons from being deviated to the upper and lower portions.

Then, the electrons moving freely in the working space (A) interact with the high frequency electric field formed between each vane 41 to oscillate a microwave, and the oscillated microwave is outputted through the cap antenna 71.

The magnetron operated as described above has the international standard which was determined by International Telecommunication Union (ITU). The standard frequency of 2450 MHZ is distributed for a food cooker, a medical equipment and an industrial apparatus, and in a domestic microwave oven, the resonance unit 40 having ten vanes is generally adopted, and has a 700 W~1000 W of a matching high frequency output.

Particularly, in an industrial or commercial oven, the output of 1250 W~1500 W is employed, and twelve vanes 41 are adopted therein to enhance its output and performance, while the domestic oven adopts ten vanes, and the height of the vanes 41 is about 9 mm~10 mm.

Then, the operating voltage is 4.3~4.7 KV, the magnetic flux density of the magnetron 51 is 1900~2100 Gauss, a diameter of the filament 33 is 4.7~5.3 mm, and a diameter of the working space (A) is 9.0~12.0 mm. When the magnetron 51 is operated under the above condition, the output is maintained to be 1250~1500 W and the efficiency about 70~72%.

However, since the industrial or commercial oven has generally twelve vanes, the magnetron 51 has a large volume and therefore an increased production cost.

SUMMARY OF THE INVENTION

Accordingly, it is an object of the present invention to provide an improved magnetron which is capable of optimizing a resonance structure by changing the number of vanes, the height of vanes, an outer diameter of a cathode and a diameter of a working space.

To achieve the above object, in a magnetron which includes a resonance unit in which a plurality of vanes are radially disposed on an inner wall of a cylindrical anode, a cathode having a spiral filament at a central portion of the cylindrical anode, a magnetic unit having a plurality of magnets at the upper and lower portion of the resonance unit, and a cooling unit having a plurality of cooling pins at its outer portion, the improvements are characterized in that the resonance unit has ten vanes having each height of 10.5 mm~12.5 mm, an outer diameter of the cathode is 4.0 mm~4.6 mm, a diameter of the working space between each symmetrical vane is 9.0 mm~12.0 mm to obtain a high frequency output of 1250 W~1500 W from an operating voltage of 4.3 kv~4.7 kv.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
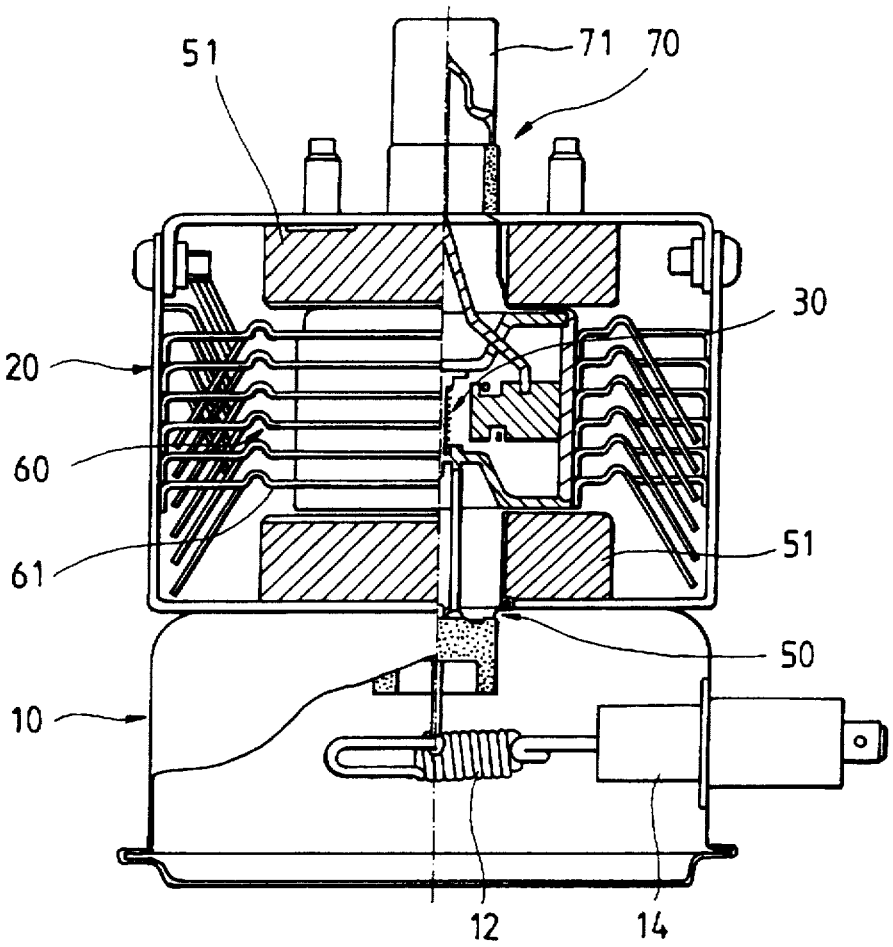
FIG. 1 CONVENTIONAL ART
FIG. 1 is a cross-sectional view showing a conventional magnetron.
Figure 2:
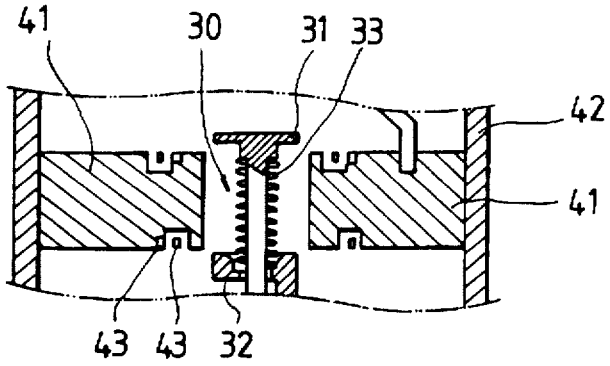
FIG. 2 CONVENTIONAL ART
FIG. 2 is an exploded cross-sectional view showing a cathode and a resonance unit of the conventional magnetron.
Figure 3:
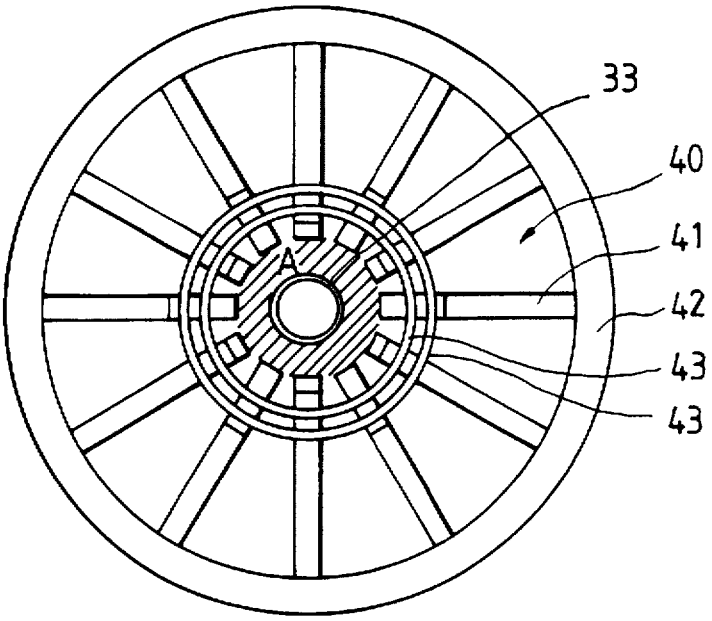
FIG. 3 CONVENTIONAL ART
FIG. 3 is a plane view showing a conventional magnetron.
Figure 4:
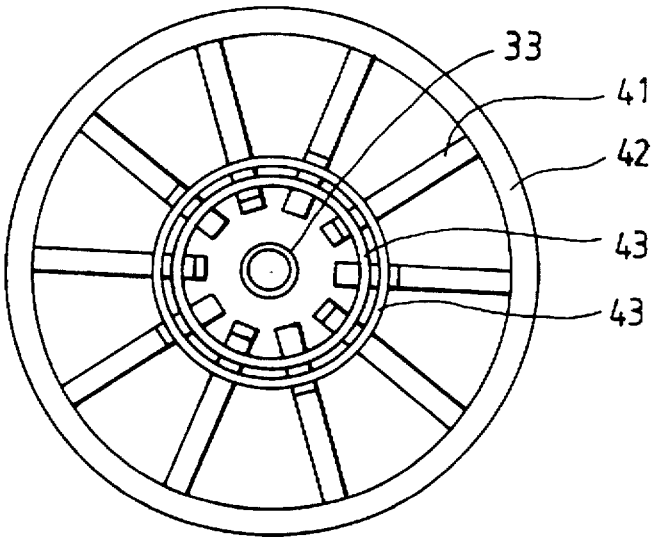
FIG. 4 is a plane view showing a magnetron according to the present invention.

As shown in FIG. 4, a magnetron according to the present invention has ten vanes in comparison with a conventional magnetron having twelve vanes.

A height($V_H$) of the vane is 10.5~12.5 mm, an outer diameter(Dc) of the cathode is 4.0~4.6 mm, and a diameter (Da) of a working space between the vanes 41 that are symmetrical is 9.0~12.0 mm.

The effective surface area of the filament 33 is 200 $mm^2$ 260 $mm^2$, a magnetic flux density thereof is 1800~2000 Gauss, and the operating voltage thereof is 4.3~4.7 KV identical to that of the conventional one.

The description of the elements identical to the conventional ones will be omitted, and the same numeral will be put to the elements of the present invention.

When the above conditions are adopted in the equations (1),(2) and (3)

$$Va = \frac{300\pi}{n\lambda}(Ra^2 - Rc^2)\left(Bg - \frac{10600}{n\lambda}\right) \quad (1)$$

Here, Va denotes an operating voltage, Ra a radius of a working space, Rc a radius of the cathode, and Bg a magnetic flux density. As is well known in the art, the character λ represents wave length. "n" is defined as "N/2" and n is universally recognized in the art as defining the number of resonators.

$$Rc/Ra \sim (N-4)/(N+4) \quad (2)$$

$$\eta = 1 - \frac{1 + Rc/Ra}{2Bg/Bo - 1 + Rc/Ra} \quad (3)$$

$$\left(\text{whereby, } Bo = \frac{20000}{n\lambda(1-\sigma)},\ \sigma = Rc/Ra\right)$$

Figure 5:
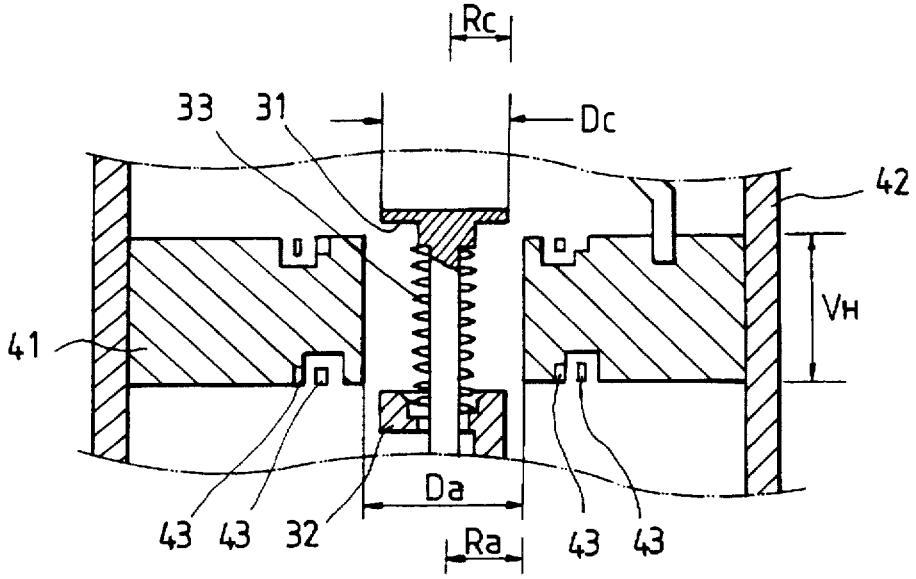
FIG. 5 is a cross-sectional view showing a height of a vane of the magnetron, an outer diameter of a cathode thereof, and a diameter of a working space thereof according to the present invention.
Figure 6:
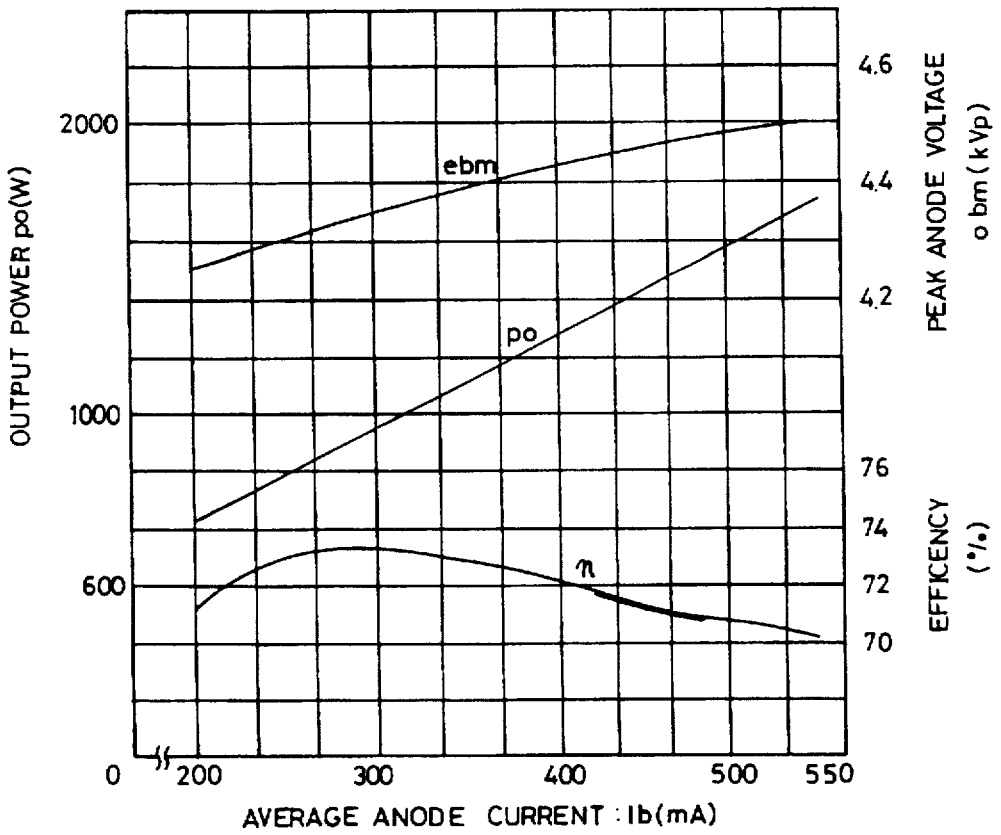
FIG. 6 is a graph showing an output and efficiency of the magnetron according to the present invention.

As shown in FIG. 5, the output of 1250~1500 W is maintained and the efficiency about 70~72%.

This means that the same output and efficiency can be achieved even when the number of the vanes is reduced to ten, the height ($V_H$) of the vanes 41 is 10.5~12.5 mm, an outer diameter (Dc) of the cathode is 4.0~4.6 mm and a diameter (Da) of the working space is 9.0~12.0 mm.

As described above, the present invention maintains an output of 1250~1500 W, and the efficiency about 70~72% by reducing the number of the vanes and changing the height ($V_H$) of the vanes, an outer diameter (Dc) of the cathode, and a diameter (Da) of the working space to achieve an effect of a compactness of a product and reduction of a production cost.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. In a magnetron which comprises a resonance means in which a plurality of vanes are radially disposed on an inner wall of a cylindrical anode, a cathode having a spiral filament at a central portion of the cylindrical anode, a magnetic means having a plurality of magnets at the upper and lower portion of the resonance means, respectively, and a cooling means having a plurality of cooling pins around its outer wall, the improvements are characterized in that the resonance means has ten vanes having each height of 10.5 mm~12.5 mm, an outer diameter of the cathode is 4.0 mm~4.6 mm, a diameter of the working space between each vane that is symmetrical is 9.0 mm~12.0 mm to obtain a high frequency output of 1250 W~1500 W from an operating voltage of 4.3 kV~4.7 kV.

* * * * *